US012146231B2

(12) United States Patent
Li et al.

(10) Patent No.: US 12,146,231 B2
(45) Date of Patent: Nov. 19, 2024

(54) PHOTOELECTRODE AND PREPARATION METHOD THEREFOR, AND PLATINUM-BASED ALLOY CATALYST AND PREPARATION METHOD THEREFOR

(71) Applicant: SOOCHOW UNIVERSITY, Suzhou (CN)

(72) Inventors: Liujing Li, Suzhou (CN); Shaolong Wu, Suzhou (CN); Peiji Guo, Suzhou (CN); Xiaofeng Li, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 312 days.

(21) Appl. No.: 17/914,299

(22) PCT Filed: Nov. 29, 2021

(86) PCT No.: PCT/CN2021/134186
§ 371 (c)(1),
(2) Date: Sep. 23, 2022

(87) PCT Pub. No.: WO2023/035424
PCT Pub. Date: Mar. 16, 2023

(65) Prior Publication Data

US 2023/0313394 A1 Oct. 5, 2023

(30) Foreign Application Priority Data

Sep. 13, 2021 (CN) ..... 202111070565.3

(51) Int. Cl.
*C25B 11/087* (2021.01)
*C25B 9/50* (2021.01)
(Continued)

(52) U.S. Cl.
CPC ..... *C25B 11/087* (2021.01); *C25B 9/50* (2021.01); *C25B 9/65* (2021.01); *C25B 11/052* (2021.01);
(Continued)

(58) Field of Classification Search
None
See application file for complete search history.

(56) References Cited

U.S. PATENT DOCUMENTS 4,492,743 A 1/1985 Howe
2023/0357939 A1* 11/2023 Ou ..... C25B 9/50

FOREIGN PATENT DOCUMENTS

CN 104900412 A 9/2015
CN 107641817 A 1/2018
(Continued)

OTHER PUBLICATIONS

English translation JP 2002-289269 (Year: 2002).*
(Continued)

*Primary Examiner* — Stefanie S Wittenberg
(74) *Attorney, Agent, or Firm* — SZDC Law PC

(57) ABSTRACT

The present application discloses a photoelectrode and a preparation method therefor, and a Pt-based alloy catalyst and a preparation method therefor. The method for preparing the Pt-based nano-alloy catalyst includes: placing a photoelectrode in an electrolytic cell with at least one light-transmitting surface and including an electrolyte; using a light source to irradiate a surface of the photoelectrode from the light-transmitting surface of the electrolytic cell, where the photoelectrode includes an active metal layer, a passivation layer, a semiconductor light absorption layer, a rear conductive layer, and an insulating protective layer that are sequentially stacked along the light incident direction; based on an electrochemical workstation and light irradiation,
(Continued)

using a Pt electrode and a reference electrode to match the photoelectrode to electrochemically treat the surface of the photoelectrode; and cleaning the electrochemically-treated photoelectrode to obtain the Pt-based nano-alloy catalyst and a photoelectrode modified by the Pt-based nano-alloy catalyst.

6 Claims, 5 Drawing Sheets

(51) Int. Cl.

| | |
|---|---|
| ***C25B 9/65*** | (2021.01) |
| ***C25B 11/052*** | (2021.01) |
| ***C25B 11/059*** | (2021.01) |
| ***C25B 11/089*** | (2021.01) |
| ***C25D 3/56*** | (2006.01) |
| ***C25D 5/48*** | (2006.01) |

(52) U.S. Cl.
CPC ..... *C25B 11/059* (2021.01); *C25B 11/089* (2021.01); *C25D 3/567* (2013.01); *C25D 5/48* (2013.01)

(56) References Cited

FOREIGN PATENT DOCUMENTS

| | | |
|---|---|---|
| CN | 108232204 A | 6/2018 |
| CN | 109252179 A | 1/2019 |
| CN | 110923817 A | 3/2020 |

OTHER PUBLICATIONS

Gautam et al. "High-resolution light-activated electrochemistry on amorphous silicon-based photoelectrodes", Chem. Commun., 2020 (Year: 2020).*

Kawamura et al. "Photoassisted control of Pt electrodeposition on p-Type Si", JES, 152, 2005 (Year: 2005).*

Zhongyuan Zhou et al., "Regulating the Silicon/Hematite Microwire Photoanode by the Conformal Al2O3 Intermediate Layer for Water Splitting" ACS Appl. Mater. Interfaces 2019, 11, 5978-5988 (Jan. 18, 2019).

* cited by examiner

PHOTOELECTRODE AND PREPARATION METHOD THEREFOR, AND PLATINUM-BASED ALLOY CATALYST AND PREPARATION METHOD THEREFOR

This application is the National Stage Application of PCT/CN2021/134186, filed on Nov. 29, 2021, which claims priority to Chinese Patent Application No. 202111070565.3, filed on Sep. 13, 2021, which is incorporated by reference for all purposes as if fully set forth herein.

TECHNICAL FIELD

The present invention relates to the field of photoelectrochemistry, specifically, to a photoelectrode and a preparation method therefor, and a Pt-based alloy catalyst and a preparation method therefor, and in particular, to a technology of photo-assisted modification of a nano-alloy.

BACKGROUND

In recent years, metal catalysts have been increasingly widely used in biochemical fields such as photocatalysis, electrocatalysis, and biosensing. Modification of precious metals on an electrode surface with a specific structure can usually improve charge transfer between the electrode and a solution interface, resulting in a significant improvement in overall electrocatalytic or photoelectrochemical performance of the electrode.

At present, a most widely used method for modifying a metal catalyst in the electrochemical field includes directly reducing (I. Oh et al., Nano Lett., 2012, 12, 298), by using an electrodeposition (T. Hoang et al., J. Am. Chem. Soc., 2018, 140, 5791) or photo-assisted electrodeposition (H. Zhang et al., Energy & Environmental Science, 2016, 9, 3113) technology, metal ions to a simple metal substance and depositing the simple metal substance on an electrode surface. However, in practical application, the lack of resources, high costs and poor stability of precious metal catalysts seriously hinder commercial development of the precious metal catalysts. Recently, researchers have tried to develop a low-cost non-precious metal catalyst, but the catalytic activity and stability thereof are far from requirements of practical application (E. Kemppainen et al., Energy Environ. Sci., 2015, 8, 2991). According to the latest research, the amount of a precious metal used can be effectively reduced by alloying the precious metals, and an alloy catalyst can still maintain satisfactory catalytic performance (S. L. Zhang et al., Angew. Chem. Int. Ed., 2021, 60, 19068). Therefore, research and development of a modification technology for precious metal alloy catalysts is one of main technical routes for academic and industrial circles to develop electrodes with high efficiency, low costs, and long service life.

Currently, a widely used method for preparing a platinum (Pt)-based alloy catalysts is to use a solution containing Pt ions and other metal ions to form the Pt-based alloy through multiple chemical reactions and heat treatments (for example, a Pt—Cu nano-alloy in the patent No. CN201810125085.4; and a Pd—Pt nano-alloy in the patent No. CN201510296670.7). However, the Pt-based alloy prepared by using this method is usually only suitable for an electrode with a plane or relatively low surface roughness. It is difficult to uniformly modify a surface of a micro-nano structured electrode (especially a one-dimensional nanostructured array) with very high surface roughness with a Pt-based alloy catalyst. In addition, this preparation method requires consumption of a lot of reagents, and utilization of a salt or acid solution containing precious metal ions is low, resulting in overall relatively-high production costs and a waste of scarce resources.

Therefore, it is required to develop a Pt-based alloy catalyst with excellent performance in low-cost modification of an electrode surface with an arbitrary morphology.

SUMMARY

To resolve the technical problems in the prior art that a process of preparation of a Pt-based alloy catalyst is complicated, resource consumption is high, and a surface of a micro-nano structured photoelectrode cannot be uniformly modified, an objective of the present application is to provide a method for modifying surfaces of a planar photoelectrode and a micro-nano structured photoelectrode by a uniformly distributed Ag—Pt nano-alloy at room temperature (without high-temperature annealing) in the presence of an electrolyte containing no precious metal ions (without additional preparation of a precursor solution containing precious metal ions), and a prepared Pt-based alloy catalyst. A counter electrode and a reference electrode that are involved in this method can be repeatedly used, which can save scarce resources and reduce an impact on an environment.

To achieve the foregoing objective, the technical solution used in the present application is as follows:

A method for preparing a photoelectrode is provided, where a p-type monocrystalline silicon substrate is selected as a planar silicon substrate, and the method includes:

1) chemically cleaning the planar silicon substrate, and then performing nanostructured treatment on a front surface of the planar silicon substrate, to obtain a silicon micro-nanowire array;
2) depositing a passivation layer with a thickness of 1-5 nm on the front surface of the planar silicon substrate or the silicon micro-nanowire array substrate;
3) depositing an active metal layer including at least one of titanium, zirconium, aluminum, zinc, iron or copper and having a thickness of 10-80 nm on the passivation layer;
4) depositing a rear conductive layer with a thickness of 100-5000 nm on a back surface of the planar silicon substrate or the silicon micro-nanowire array; and
5) fixing a wire to the rear conductive layer by using an adhesive, and insulating and sealing the rear conductive layer, the adhesive, and the wire, so that the planar silicon substrate or the silicon micro-nanowire array exposes only a region in which the active metal layer is deposited as an effective operation region of the photoelectrode, to obtain the photoelectrode. In this way, a photoelectrode monomer is obtained, and on this basis, the photoelectrode modified by the Pt-based nano-alloy catalyst is obtained through further improvement.

Preferably, a p-type semiconductor substrate is a light absorption layer, with a doping concentration of $10^{14}$-$10^{18}$ $cm^{-3}$; and the light absorption layer has a thickness of 1-1000 μm.

The present application provides a photoelectrode prepared by using the foregoing method for preparing a photoelectrode.

The present application provides a method for preparing a Pt-based (nano) alloy catalyst (also referred to as a method for photo-assisted modification of a Pt-based nano-alloy on a photoelectrode surface), including:

placing the to-be-treated photoelectrode with a composite layer structure obtained by using the foregoing method in an electrolytic cell with at least one light-transmitting surface and including an electrolyte;

causing excitation light emitted by a light source to irradiate a surface of the photoelectrode from the light-transmitting surface of the electrolytic cell, where the photoelectrode includes an active metal layer, a passivation layer, a semiconductor light absorption layer, a rear conductive layer, and an insulating protective layer that are sequentially stacked in an incident direction of the excitation light;

based on an electrochemical workstation, and under the irradiation of the excitation light, using a Pt electrode and a reference electrode to match the photoelectrode to electrochemically treat the surface of the photoelectrode; and cleaning the electrochemically-treated photoelectrode to obtain a photoelectrode modified by an Ag—Pt nano-alloy. In the process of multiple linear or cyclic potential scans on the surface of the photoelectrode under illumination, the active metal layer of the photoelectrode is gradually dissolved by the electrolyte, and the Ag—Pt nano-alloy is formed on the surface of the photoelectrode (that is, the photoelectrode modified by the Pt-based nano-alloy is obtained).

Preferably, electrochemical treatment is performed on the surface of the photoelectrode under the irradiation of simulated sunlight, and the electrochemical treatment is repeated by linear potential scanning, with a potential range of +0.5 V vs. RHE to −2.5 V vs. RHE.

Preferably, scanning is performed for 5-20 times.

Preferably, the electrolyte is one of 0.1-5 mol/L sulfuric acid, hydrochloric acid, nitric acid, boric acid, phosphoric acid or carbonic acid.

Preferably, the reference electrode is a saturated Ag/AgCl electrode.

The present application further provides a Pt-based alloy catalyst prepared by using the foregoing method.

Beneficial Effects

In implementations of the present application, the prepared Pt-based nano-alloy is used, so that surfaces of a planar photoelectrode and a micro-nano structured photoelectrode can undergo photo-assisted modification by a uniformly distributed Ag—Pt nano-alloy at room temperature (without high-temperature annealing) in the presence of an electrolyte containing no precious metal ions and without additional preparation of a precursor solution containing precious metal ions, and a counter electrode and a reference electrode involved can be repeatedly used. The processes of oxidation and dissolution of an active metal on the front surface of the working electrode and the alloying of Ag and Pt elements (Pt counter electrode) alternate. This in-situ replacement process ensures that the nano-alloy can be formed on the surface of a working electrode with an arbitrary morphology, and the nano-alloy has a controllable size and uniform spatial distribution. Experiments show that the obtained nano-alloy catalyst according to the implementations of the present application has excellent and stable catalytic activity, and the obtained photoelectrode has excellent photoelectrochemical performance.

DESCRIPTION OF EMBODIMENTS

Figure 1:
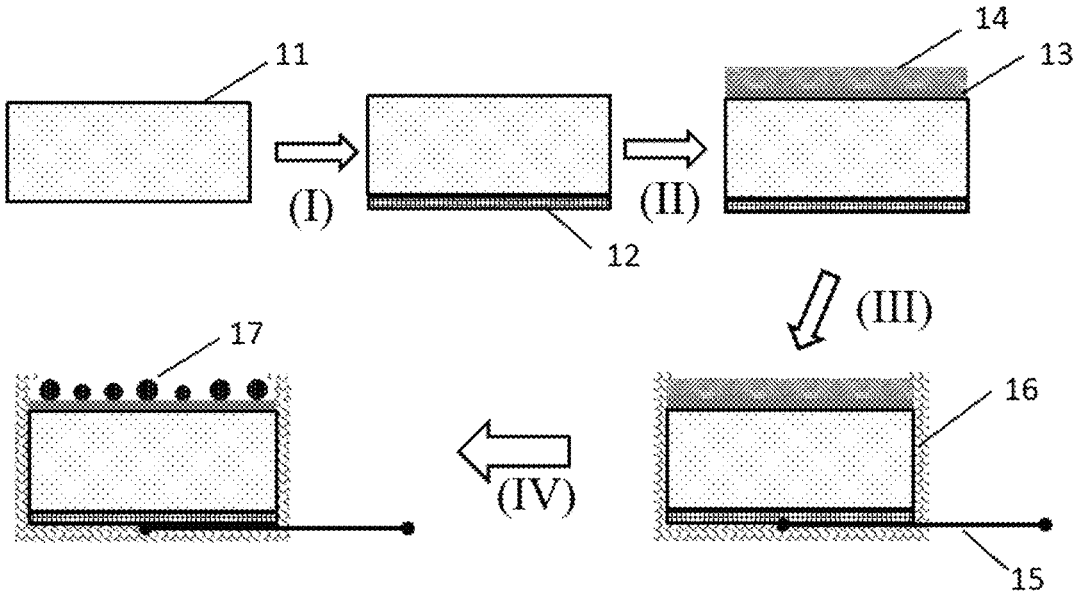
FIG. 1 is a flowchart of photo-assisted modification of a Pt-based nano-alloy on a surface of a planar photoelectrode.

The foregoing solutions are further described below with reference to specific embodiments. It should be understood that these embodiments are used to illustrate the present application and are not used to limit the scope of the present application. Implementation conditions adopted in the embodiments can be further adjusted as conditions of specific manufacturers, and implementation conditions not indicated are usually those in routine experiments.

The present application provides a photoelectrode, which takes p-type monocrystalline silicon as a substrate. A method for preparing the photoelectrode includes the following steps.

1) Chemically clean a planar silicon substrate, and then perform nanostructured treatment on a front surface of the planar silicon substrate, to obtain a silicon micro-nanowire array.

2) Deposit a passivation layer with a thickness of 1-5 nm on the front surface of the planar silicon substrate or the silicon micro-nanowire array substrate.
3) Deposit an active metal layer including at least one of titanium, zirconium, aluminum, zinc, iron or copper and having a thickness of 10-80 nm on the passivation layer.
4) Deposit a rear conductive layer with a thickness of 100-5000 nm on a back surface of the planar silicon substrate or the silicon micro-nanowire array.
5) Fix a wire to the rear conductive layer by using an adhesive, and insulate and seal the rear conductive layer, the adhesive, and the wire, so that the planar silicon substrate or the silicon micro-nanowire array exposes only a region in which the active metal layer is deposited as an effective operation region of the photoelectrode, to obtain the photoelectrode.

A p-type semiconductor substrate is a light absorption layer, with a doping concentration of $10^{14}$-$10^{18}$ $cm^{-3}$. The light absorption layer has a thickness of 1-1000 μm. The photoelectrode has a composite layer structure, and includes an active metal layer, a passivation layer, a semiconductor light absorption layer, a rear conductive layer, and an insulating protective layer in an incident direction of the light.

Step 1) includes cutting a substrate to a target size, chemically cleaning the substrate, and performing nano-structured treatment on the planar silicon substrate, to obtain the silicon micro-nanowire array which may be prepared by referring to the patent (No. CN 200810183135.0 or No. CN 201610183558.7).

Next, a method for preparing a Pt-based nano-alloy on the surface of the foregoing photoelectrode (also referred to as a method for photo-assisted modification of a Pt-based nano-alloy on a photoelectrode surface) is described. The method includes: placing a photoelectrode in an electrolytic cell with at least one light-transmitting surface and including an electrolyte; causing excitation light emitted by a light source to irradiate a surface of the photoelectrode from the light-transmitting surface of the electrolytic cell, where the photoelectrode includes an active metal layer, a passivation layer, a semiconductor light absorption layer, a rear conductive layer, and an insulating protective layer that are sequentially stacked in an incident direction of the excitation light; based on an electrochemical workstation, and under the irradiation of the excitation light, using a Pt electrode and a reference electrode to match the photoelectrode to electrochemically treat the surface of the photoelectrode; and performing multiple linear or cyclic potential scans on the surface of the photoelectrode under illumination, where during the scans, the active metal layer of the photoelectrode is gradually dissolved in an electrolyte, and the Ag—Pt nano-alloy is formed on the surface of the photoelectrode (that is, the photoelectrode modified by the Pt-based nano-alloy catalyst is obtained).

In this implementation, a saturated Ag/AgCl electrode is used as the reference electrode, a Pt electrode is used as the counter electrode, and the photoelectrode obtained in step 5) is used as the working electrode. The electrolyte is 0.1-5 mol/L sulfuric acid, hydrochloric acid or phosphoric acid. Under irradiation of simulated sunlight, the working electrode is scanned linearly in the potential range of +0.5 V vs. RHE to −2.5 V vs. RHE (for example, for 5-20 times). Photoelectrochemical performance tests of the obtained photoelectrode under irradiation of simulated sunlight showed that a saturated photocurrent of the planar silicon photoelectrode modified by the Ag—Pt nano-alloy could be significantly increased (greater than 2 $mA/cm^2$), while a turn-on potential thereof was greatly reduced (greater than 0.42 V); a saturated photocurrent of the silicon micro-nanowire array photoelectrode modified by the Ag—Pt nano-alloy reached 33.3 $mA/cm^2$, an overpotential required for the photocurrent to reach 10 $mA/cm^2$ was as low as 0 V vs. RHE, and the photocurrent had no obvious decrease during the 28-hour test period.

Formation Mechanism of the Alloy:

In the solution of the present application, when the photoelectrode surface undergoes multiple linear or cyclic potential scans under illumination, the active metal layer of the photoelectrode is gradually dissolved in the electrolyte, and the Ag—Pt nano-alloy is formed on the photoelectrode surface. The formation mechanism of the alloy: A semiconductor light absorption layer absorbs excitation light to generate photo-generated electrons and photo-generated hole pairs. When a positive potential acts on the photoelectrode, photo-generated holes promote the oxidation of active metals on the front surface, and the oxidized metals are gradually dissolved in an acidic electrolyte. When a negative potential acts on the photoelectrode, the Pt electrode is under action of a relatively positive potential. If the potential of the Pt electrode reaches or is more positive than 1.2 V vs. RHE, the $Pt^{2+}$ ions can be dissolved out of the Pt electrode and enter the electrolyte. In addition, the $Ag^{+}$ ions in a saturated Ag/AgCl reference electrode permeate into the electrolyte to some extent. Since the redox potentials of $Ag^{+}/Ag$ and $Pt^{2+}/Pt$ are more positive than that of $Ti^{4+}/Ti$, and the light-illuminated Si absorber can provide the required electrons, Ag—Pt NPs can be thermodynamically deposited on the Si substrate through galvanic replacement reactions. When the active metals on the front surface of the working electrode are completely dissolved, the formation amount of the Ag—Pt nano-alloy tends to be saturated, that is, the Ag—Pt nano-alloy is not added continuously with repeated potential scanning.

The active metals on the front surface of the photoelectrode play a promoting or even decisive role in the formation of the Ag—Pt nano-alloy. The active metals on the front surface are gradually dissolved in multiple linear potential scans to completely disappear, and the Ag—Pt nano-alloy is gradually formed to saturation on the photoelectrode surface. Correspondingly, the photoelectrode surface is gradually modified by the Ag—Pt nano-alloy catalyst, and corresponding electrocatalytic and photoelectrochemical performance is gradually improved to finally keep a stable state. When the surface of the photoelectrode is processed into a structured silicon micro-nanowire array, a specific surface area of the photoelectrode is greatly increased, and the light absorption capacity is also significantly enhanced, which is conducive to the generation of photo-generated electrons and photo-generated holes and promotes the formation of the Ag—Pt alloy through reduction. Because the active metal layer completely wraps the semiconductor light absorption layer, the formed Ag—Pt alloy can be uniformly distributed on the surface of the photoelectrode. In the absence of light, although the photoelectrode at a negative potential can make the Pt counter electrode at a positive potential slightly oxidized and dissolved (that is, the dark current density is very small), $Ag^{+}$ and $Pt^{2+}$ in the solution cannot be reduced to the Ag—Pt nano-alloy on the photoelectrode surface. However, under the condition of illumination, the oxidation and dissolution amount of the Pt counter electrode increases significantly (the photocurrent is very high), and the Ag—Pt alloy can be successfully formed on the surface of the photoelectrode through reduction. In addition, when the active metal layer is excessively thin (for example, 10 nm or below), it is difficult to form a continuous film on the surface of the nanostructured semiconductor layer, and the time required for the active metals to be completely dissolved is excessively short, so that the formed Ag—Pt alloy has an excessively small size, is excessively sparse, and has excessively low catalytic performance. When the active metal layer is excessively thick, it is difficult for incident light to penetrate the metal layer and be absorbed by the semiconductor, and there are no or very few photo-generated electrons and holes, which is not conducive to the photo-assisted metal oxidation and the formation of the photo-assisted Ag—Pt alloy through reduction.

The passivation layer introduced between the active metal layer and the semiconductor light absorption layer can effectively inhibit the recombination of photo-generated carriers at an interface, thus promoting oxidization of the active metal layer by the photo-generated holes, and promoting the reduction of $Ag^+$ and $Pt^{2+}$ on the photoelectrode surface. However, the thickness of the passivation layer should not be excessively large (e.g., greater than 10 nm), otherwise the passivation layer hinders the transmission of photo-generated electrons and holes between the light absorption layer and the surface of the photoelectrode, thus inhibiting the oxidation of active metals on the front surface and the formation of the Ag—Pt alloy through reduction. It should be noted that the used electrolyte must be acidic, otherwise the oxidized active metals on the front surface cannot be dissolved in the electrolyte, thus forming an oxide protective layer on the surface of the active metal, thus making the subsequent oxidation process of the active metals on the front surface unsustainable.

In implementations, the preparation of the photoelectrode and the preparation of the Pt-based nano-alloy catalyst on the surface of the photoelectrode are coherent actions.

Next, the implementations of the present application are described with reference to the drawings.

Embodiment 1

A method for preparing a Pt-based (nano) alloy for photo-assisted modification on a surface of a photoelectrode is shown in FIG. 1. In this figure, a planar silicon substrate 11, a rear conductive layer 12, a passivation layer 13, an active metal layer 14, a wire 15 drawn from the rear conductive layer, an insulating protective layer 16, and a Pt-based nano-alloy layer 17 are provided. Step I: Manufacture a conductive layer on a back surface of a planar silicon substrate. Step II: Sequentially deposit a passivation layer and an active metal layer on a front surface of the planar silicon substrate successively. Step III: Lead out an external wire on the rear conductive layer, and wrap a back surface and a side wall of a semiconductor substrate with an insulating sealant. Step IV: Electrochemically treat the manufactured photoelectrode in an acidic electrolyte under illumination, with a Pt electrode as the counter electrode and a saturated Ag/AgCl electrode as the reference electrode. A specific preparation process based on p-type monocrystalline silicon includes the following main steps.

Figure 2:
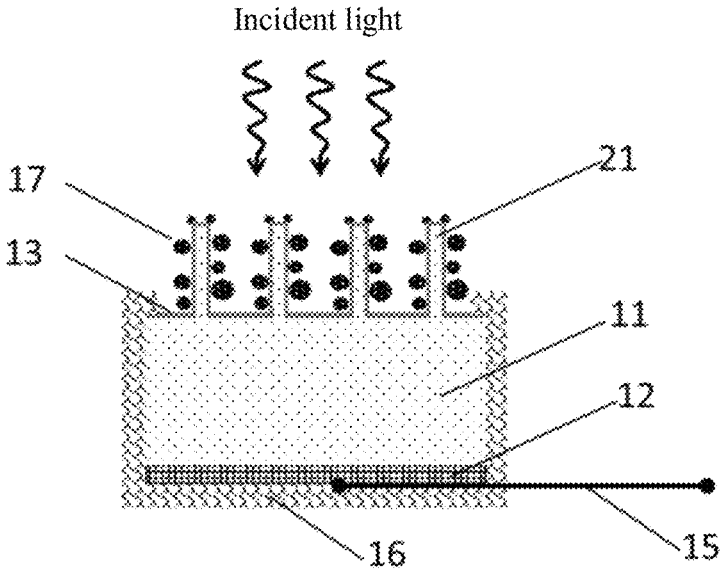
FIG. 2 is a schematic structural diagram of a silicon micro-nanowire array photoelectrode modified by a Pt-based nano-alloy layer, where a silicon micro-nanowire array 21 is provided.
Figure 3:
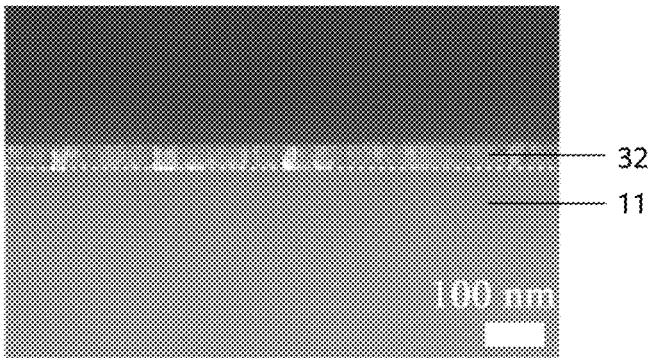
FIG. 3 is a cross-sectional scanning electron microscope image of a planar silicon substrate on which titanium oxide and a titanium layer are successively deposited, where a titanium layer 32 that is 40 nm thick (note that a layer of titanium oxide that is 2 nm thick is provided between 31 and the titanium layer 32, but this layer cannot be distinguished by a scanning electron microscope because of an excessively small thickness) is provided.
Figure 4:
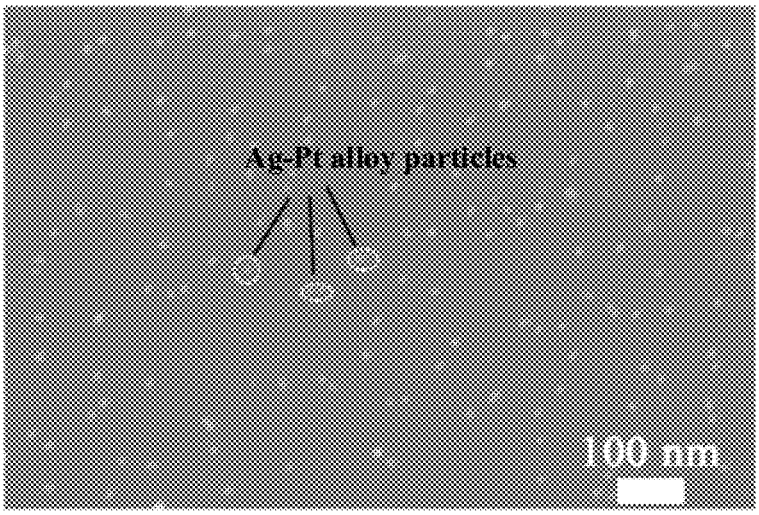
FIG. 4 is a top scanning electron microscope image of a planar silicon photoelectrode with a surface modified by an Ag—Pt nano-alloy layer.
Figure 5:
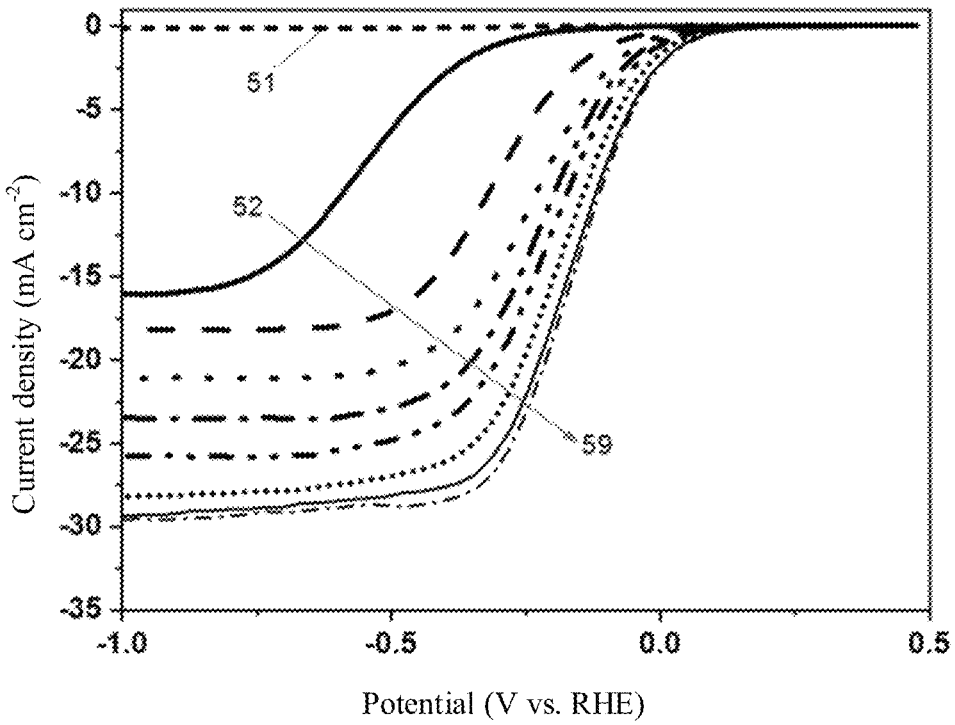
FIG. 5 is a current density-potential curve chart of a planar silicon photoelectrode with titanium oxide and a titanium layer deposited on a surface successively during multiple continuous linear potential scans, where a current density-potential curve 51 in a dark state and current density-potential curves 52-59 obtained from a first test to an eighth test respectively under irradiation of simulated sunlight are provided.

1) Chemically clean a planar silicon substrate, and soak the planar silicon substrate in dilute HF to remove an oxide layer; perform nanostructured treatment on the cleaned planar silicon substrate to obtain a silicon micro-nanowire array, as shown in FIG. 2, which is a schematic structural diagram of a silicon micro-nanowire array 21 photoelectrode modified by a Pt-based nano-alloy layer.
2) Sputter a layer of 200 nm AlSiCu on a back surface of the planar silicon substrate, and then anneal for 10 min in the atmosphere of nitrogen at 500° C. to obtain a rear conductive layer.
3) First grow a layer of 2 nm $TiO_2$ on a front surface of the planar silicon substrate by using the atomic layer deposition technology, and then grow a layer of 40 nm metal Ti (titanium) (active metal layer) by using a sputtering technology. A scanning electron microscope image of the obtained multilayer structure is shown in FIG. 3, where a titanium layer 32 that is 40 nm thick (note that a layer of titanium oxide that is 2 nm thick is provided between 31 and the titanium layer 32, but this layer cannot be distinguished by a scanning electron microscope because of an excessively small thickness) is provided.
4) Lead out an external wire on the rear conductive layer of the planar silicon substrate by using a conductive adhesive, and wrap and seal the rear conductive layer, the side wall and the external wire of the planar silicon substrate by using insulating rubber, so that only a region with a Ti layer deposited on the front surface is exposed.
5) Place the sealed photoelectrode into a three-electrode system (main conditions include: a Ag/AgCl reference electrode, a Pt counter electrode and the prepared photoelectrode are provided and placed in an electrolytic cell containing 0.5 M $H_2SO_4$ electrolyte and the photoelectrode is irradiated by simulated AM 1.5 G sunlight), and perform multiple repeated linear potential scans (+0.5 V vs. RHE to −2.5 V vs. RHE) on the photoelectrode by an electrochemical workstation. The obtained current density-potential curve is shown in FIG. 5, where a current density-potential curve 51 in a dark state and current density-potential curves 52-59 obtained from a first test to an eighth test respectively under irradiation of simulated sunlight are provided. Finally, the planar silicon photoelectrode with the surface modified by the Ag—Pt nano-alloy is obtained (as shown in FIG. 4).

In the absence of light, the dark current density of the photoelectrode at −1.0 V vs. RHE was only 0.01 mA/cm$^2$. After irradiation of simulated sunlight and continuous linear potential scans, it was observed that the density of the saturated photocurrent gradually increased with the potential scans, from 16.1 mA/cm$^2$ in the first potential scan to 29.3 mA/cm$^2$ in the seventh scan, and then stabilized at about 29.5 mA/cm$^2$. In addition, the turn-on potential gradually moved in an anodic direction from −0.21 vs. RHE in the first scan to +0.20 vs. RHE in the seventh scan, and then stabilized at this value. Before the electrochemical test, there was no Ag—Pt alloy on the planar silicon substrate. After 7 or more linear potential scans under illumination, the Ag—Pt nano-alloy was uniformly distributed on the planar silicon surface, with a size distribution range of 10-40 nm. It can be learned that by using the solution of this implementation of the present application, photo-assisted modification of the Pt-based alloy catalyst on the surface of the planar photoelectrode can be performed (see FIG. 1*a*), and photoelectrochemical performance of the modified photoelectrode can be significantly improved. In an implementation, an insulating protective layer 16 can be removed after manufacturing.

Figure 1A:
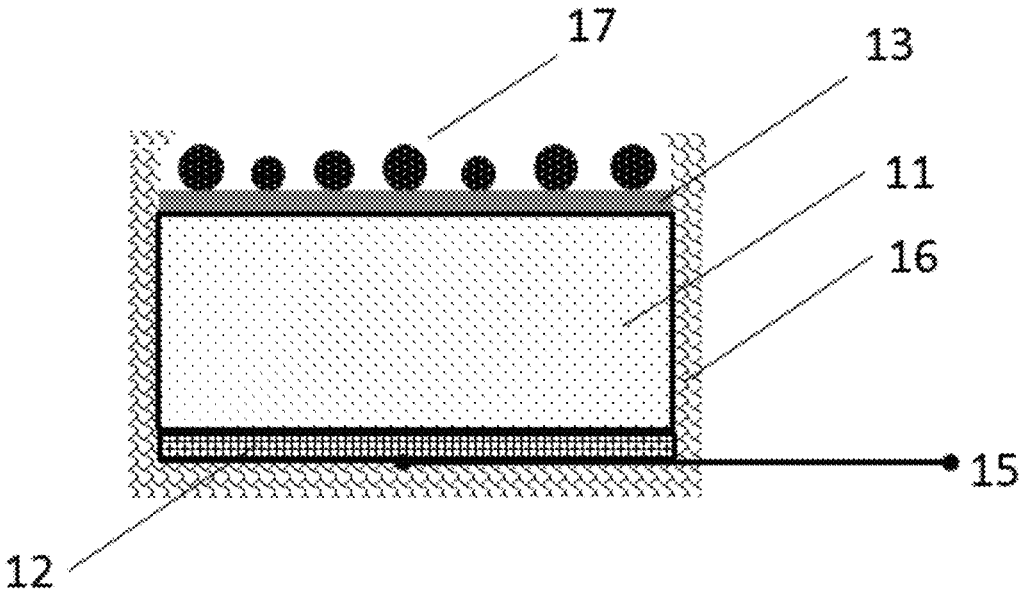
FIG. 1*a* is a schematic cross-sectional view of an assisted-modification Pt-based nano-alloy obtained by using a method of FIG. 1, where a planar silicon substrate 11, a rear conductive layer 12, a passivation layer 13, an active metal layer 14, a wire 15 drawn from the rear conductive layer, an insulating protective layer 16, and a Pt-based nano-alloy layer 17 are provided.

The obtained photoelectrode is shown in FIG. 1*a*, and a p-type monocrystalline silicon substrate is selected as a planar silicon substrate.

A side of the planar silicon substrate 11 is provided with a rear conductive layer 12, and the rear conductive layer is connected to a wire 15.

A side of the planar silicon substrate 11 opposite to the rear conductive layer 12 is provided with a silicon micro-nanowire array layer 17 and an active metal layer 14. Preferably, an outer side of the photoelectrode is wrapped with an insulating layer 16, and only the active metal layer 14 is exposed. The silicon micro-nanowire array layer 17 is deposited on the exposed surface of the active metal layer 14.

Embodiment 2

This embodiment differs from Embodiment 1 in that a planar silicon substrate is processed into a silicon micro-nanowire array structure first, and then subsequent photo-assisted modification of a Pt-based alloy is performed. A main preparation process includes the following steps.

Figure 6:
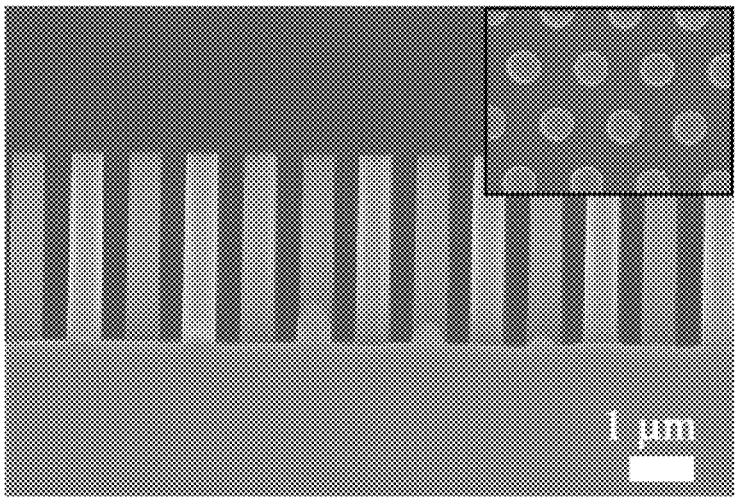
FIG. 6 is a cross-sectional scanning electron microscope image of a silicon micro-nanowire array prepared on a planar silicon substrate.
Figure 7:
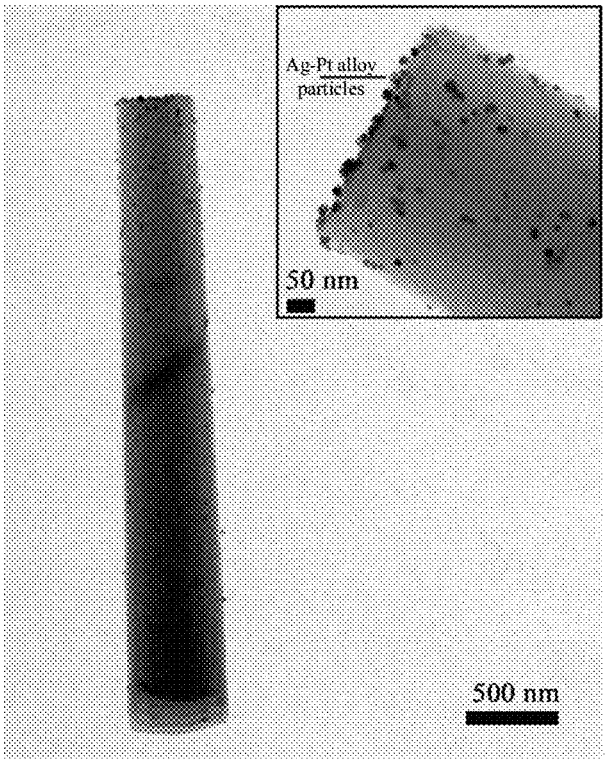
FIG. 7 is a transmission electron microscope image of a single silicon nanowire modified by an Ag—Pt nano-alloy layer.
Figure 8:
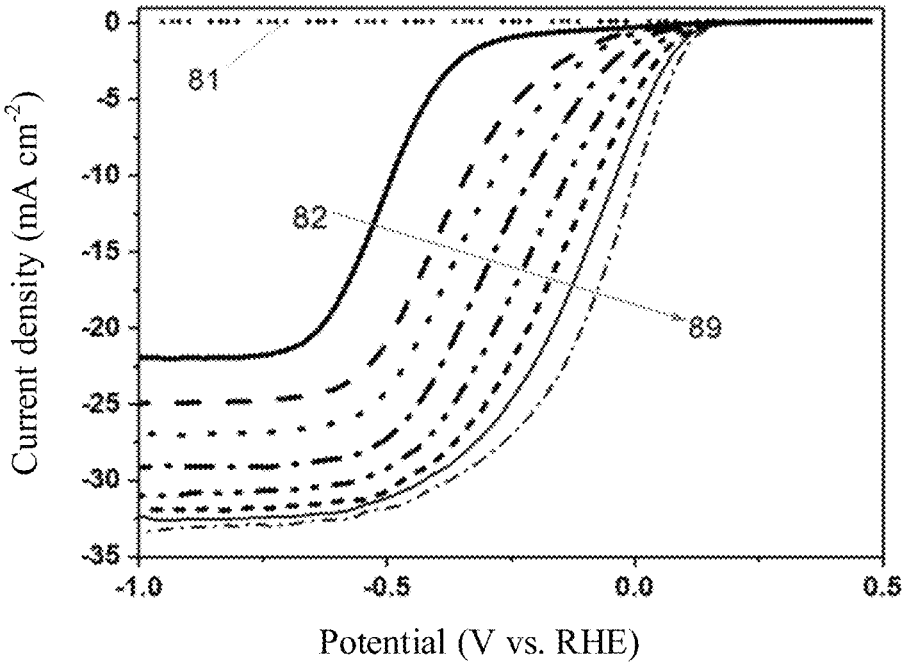
FIG. 8 is a current density-potential curve chart of a silicon micro-nanowire array photoelectrode with titanium oxide and a titanium layer deposited on a surface successively during multiple continuous linear potential scans.

1) Chemically clean a planar silicon substrate, and reduce a size of polystyrene (PS) spheres on a front surface of the planar silicon substrate through self-assembly of the PS spheres and by using a reactive ion etching process to obtain a PS sphere colloid mask.
2) Deposit, through electron beam evaporation, a 5/40 nanometer titanium/gold bimetallic layer on the planar silicon substrate containing the PS sphere mask, and then place the planar silicon substrate in tetrahydrofuran and chloroform in sequence for ultrasonic treatment for 10 min to remove the PS sphere colloid mask.
3) Etch in a mixed aqueous solution of HF and $H_2O_2$ for 100 min to prepare an ordered silicon micro-nanowire array, and then remove the residual titanium/gold with aqua regia to obtain the silicon micro-nanowire array, with a morphology shown in FIG. 6, where an illustration in the upper right corner is a top view of a silicon micro-nanowire array at the same magnification.
4) Manufacture a rear conductive layer on a back surface of the silicon micro-nanowire array (a specific method and parameters are the same as those in Embodiment 1).
5) Deposit a $TiO_2$ layer and a Ti layer on the front surface of the silicon micro-nanowire array successively (a specific method and parameters are the same as those in Embodiment 1).
6) Lead out an external wire on the rear conductive layer of the silicon micro-nanowire array, and wrap and seal the rear conductive layer, the side wall and the external wire of the planar silicon substrate by using silicon insulating rubber, so that only a region with a Ti layer deposited on the front surface is exposed.
7) Place the sealed photoelectrode into a three-electrode test system, and perform multiple repeated linear potential scanning tests by using an electrochemical workstation (specific conditions are the same as those in Embodiment 1), with a current density-potential curve obtained from the test shown in FIG. 8, and finally obtain a silicon micro-nanowire array photoelectrode with a surface modified by an Ag—Pt nano-alloy (the micro-morphology of a single nanowire is shown in FIG. 7, where an illustration in the upper right corner is an enlarged view of the top of the nanowire).

In FIG. 8, a current density-potential curve 81 in a dark state and current density-potential curves 82-89 obtained from a first test to an eighth test respectively under irradiation of simulated sunlight are provided.

Figure 9:
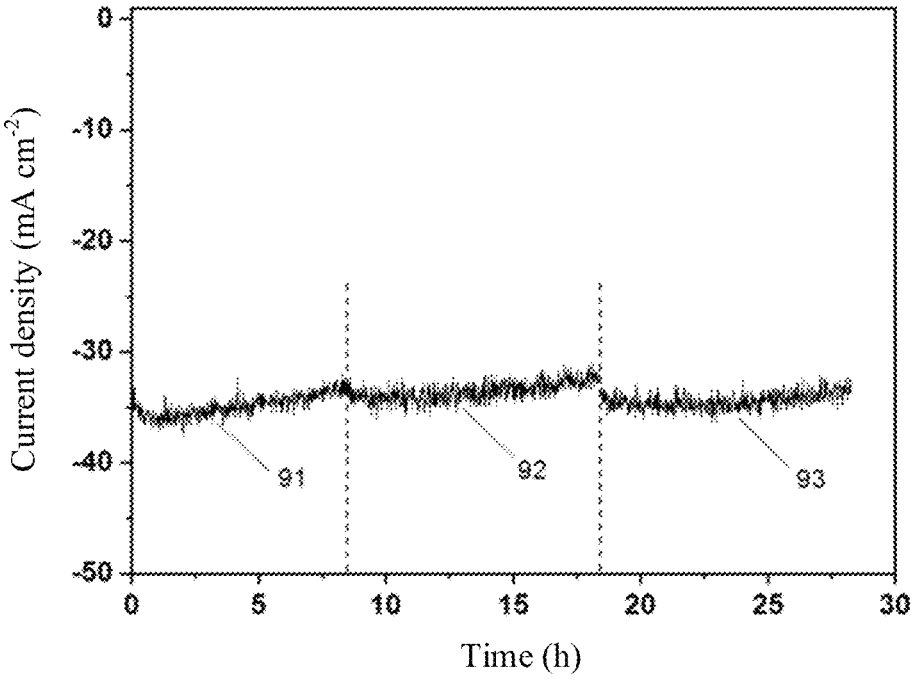
FIG. 9 shows a corresponding photocurrent density versus test time change relationship of a silicon nanowire photoelectrode modified by an Ag—Pt nano-alloy layer at a potential of −0.8 V vs. RHE.

In the absence of light, the dark current density of the photoelectrode was only 0.02 mA/cm$^2$. After irradiation of simulated sunlight and continuous scans, it was observed that the density of the saturated photocurrent gradually increased from 22.0 mA/cm$^2$ in the first linear potential scan to 33.3 mA/cm$^2$ in the eighth scan. In addition, the turn-on potential gradually moved from −0.10 vs. RHE in the first scan to +0.23 vs. RHE in the eighth scan. It was concluded by analyzing the micro-morphology after linear potential scanning of the photoelectrode for different times that, after seven linear potential scans, the Ag—Pt nano-alloy was formed and stabilized on the surface of the silicon nanowire, and the Ti layer deposited before completely disappeared. Further, stability of the silicon micro-nanowire array photoelectrode with the surface modified by the Ag—Pt nano-alloy was tested (under the condition that −0.8 V vs. RHE potential was applied in a 0.5 M $H_2SO_4$ electrolyte under irradiation of simulated sunlight, the relationship between the current density and the test time was observed), and obtained results are shown in FIG. 9, where a first-stage test result 91 (using 72 mL of 0.5 mol/L sulfuric acid as an electrolyte), a second-stage test result 92 (still using the electrolyte after the first-stage test), and a third-stage test result 93 (using 72 mL of newly-prepared 0.5 mol/L sulfuric acid electrolyte) are provided.

The attenuation of the photocurrent density of the silicon nanowire photoelectrode modified by the Ag—Pt nano-alloy could be neglected under the condition of the continuous three-stage test (8-10 hours each time), indicating that a photoelectrode with excellent catalytic activity can be prepared by using a method for photo-assisted modification of a Pt-based nano-alloy, and has excellent long-term working stability.

Photoelectrochemical performance tests of the obtained photoelectrode under irradiation of simulated sunlight showed that a saturated photocurrent of the planar silicon photoelectrode modified by the Ag—Pt nano-alloy could be significantly increased (greater than 2 mA/cm$^2$), while a turn-on potential thereof was greatly reduced (greater than 0.42 V); a saturated photocurrent of the silicon micro-nanowire array photoelectrode modified by the Ag—Pt nano-alloy reached 33.3 mA/cm$^2$, an overpotential required for the photocurrent to reach 10 mA/cm$^2$ was as low as 0 V vs. RHE, and the photocurrent had no obvious decrease during the 28-hour test period.

An embodiment of the present application provides a Pt-based alloy catalyst (also referred to as a Pt-based nano-alloy catalyst) prepared by using the foregoing method.

The foregoing embodiments are only intended to illustrate the technical concept and characteristics of the present application, so that a person skilled in the art can understand the content of the present application and implement the content accordingly, and the embodiments cannot be used to limit the protection scope of the present application. Any equivalent transformation or modification made based on the spirit of the present application should fall within the protection scope of the present application.

What is claimed is:

1. A method for preparing a Pt-based nano-alloy catalyst, comprising:

preparing a photoelectrode:

providing a p-type monocrystalline silicon substrate as a planar silicon substrate, the p-type monocrystalline silicon substrate being a light absorption layer, with a doping concentration of $10^{14}$-$10^{18}$ cm$^{-3}$, and the light absorption layer having a thickness of 1-1000 μm;

chemically cleaning the planar silicon substrate, and then performing nanostructured treatment on a front surface of the planar silicon substrate, to obtain a silicon micro-nanowire array;

depositing a passivation layer with a thickness of 1-5 nm on the front surface of the planar silicon substrate or the silicon micro-nanowire array substrate;

depositing an active metal layer comprising at least one of titanium, zirconium, aluminum, zinc, iron or copper and having a thickness of 10-80 nm on the passivation layer;

depositing a rear conductive layer with a thickness of 100-5000 nm on a back surface of the planar silicon substrate or the silicon micro-nanowire array substrate;

fixing a wire to the rear conductive layer by using an adhesive, and insulating and sealing the rear conductive layer, the adhesive, and the wire, so that the planar silicon substrate or the silicon micro-nanowire array exposes only a region in which the active metal layer is deposited as an effective operation region of the photoelectrode, to obtain the photoelectrode;

placing the photoelectrode in an electrolytic cell with at least one light-transmitting surface and comprising an electrolyte;

causing excitation light emitted by a light source to irradiate a surface of the photoelectrode from the light-transmitting surface of the electrolytic cell, wherein the photoelectrode comprises an active metal layer, a passivation layer, a semiconductor light absorption layer, a rear conductive layer, and an insulating protective layer that are sequentially stacked in an incident direction of the excitation light;

based on an electrochemical workstation, and under the irradiation of the excitation light, using a Pt electrode and a reference electrode to match the photoelectrode to electrochemically treat the surface of the photoelectrode; and cleaning the electrochemically-treated photoelectrode to obtain a photoelectrode modified by an Ag—Pt nano-alloy catalyst.

2. The method for preparing a Pt-based nano-alloy catalyst according to claim 1, wherein based on an electrochemical workstation, and under the irradiation of the excitation light, using a Pt electrode and a reference electrode to match the photoelectrode at room temperature to electrochemically treat the surface of the photoelectrode.

3. The method for preparing a Pt-based nano-alloy catalyst according to claim 1, wherein electrochemical treatment is performed on the surface of the photoelectrode under the irradiation of light, and the electrochemical treatment is repeated linear potential scanning, with a potential range of +0.5 V vs. RHE to −2.5 V vs. RHE.

4. The method for preparing a Pt-based nano-alloy catalyst according to claim 3, wherein scanning is performed for 5-20 times.

5. The method for preparing a Pt-based nano-alloy catalyst according to claim 1, wherein the electrolyte is one of 0.1-5 mol/L sulfuric acid, hydrochloric acid, nitric acid, boric acid, phosphoric acid or carbonic acid.

6. The method for preparing a Pt-based nano-alloy catalyst according to claim 1, wherein the reference electrode is a saturated Ag/AgCl electrode.

* * * * *